United States Patent [19]

Antal

[11] 4,155,835

[45] May 22, 1979

[54] DESULFURIZATION OF NAPHTHA CHARGED TO BIMETALLIC CATALYST REFORMING

[75] Inventor: Michael J. Antal, Trenton, N.J.

[73] Assignee: Mobil Oil Corporation, New York, N.Y.

[21] Appl. No.: 883,450

[22] Filed: Mar. 6, 1978

[51] Int. Cl.[2] ..... C10G 23/00

[52] U.S. Cl. ..... 208/89

[58] Field of Search ..... 208/89, 116 R, 212

[56] References Cited

U.S. PATENT DOCUMENTS

| | | | |
|---|---|---|---|
| 3,556,986 | 1/1971 | Beck et al. | 208/89 |
| 3,660,276 | 5/1972 | Lacey | 208/212 |
| 3,801,494 | 4/1974 | Moore et al. | 208/89 |
| 3,898,153 | 8/1975 | Louder et al. | 208/89 |

*Primary Examiner*—George Crasanakis

*Attorney, Agent, or Firm*—Charles A. Huggett; Carl D. Farnsworth

[57] ABSTRACT

A hydrocarbon fraction boiling below about 430° F. and initially desulfurized to contain not more than about 2 ppm weight of sulfur is further desulfurized to comprise less than 0.5 ppm sulfur by sequential contact with a desulfurizing catalyst and a bed of zinc oxide before effecting bimetallic reforming of a naphtha boiling fraction.

3 Claims, 1 Drawing Figure

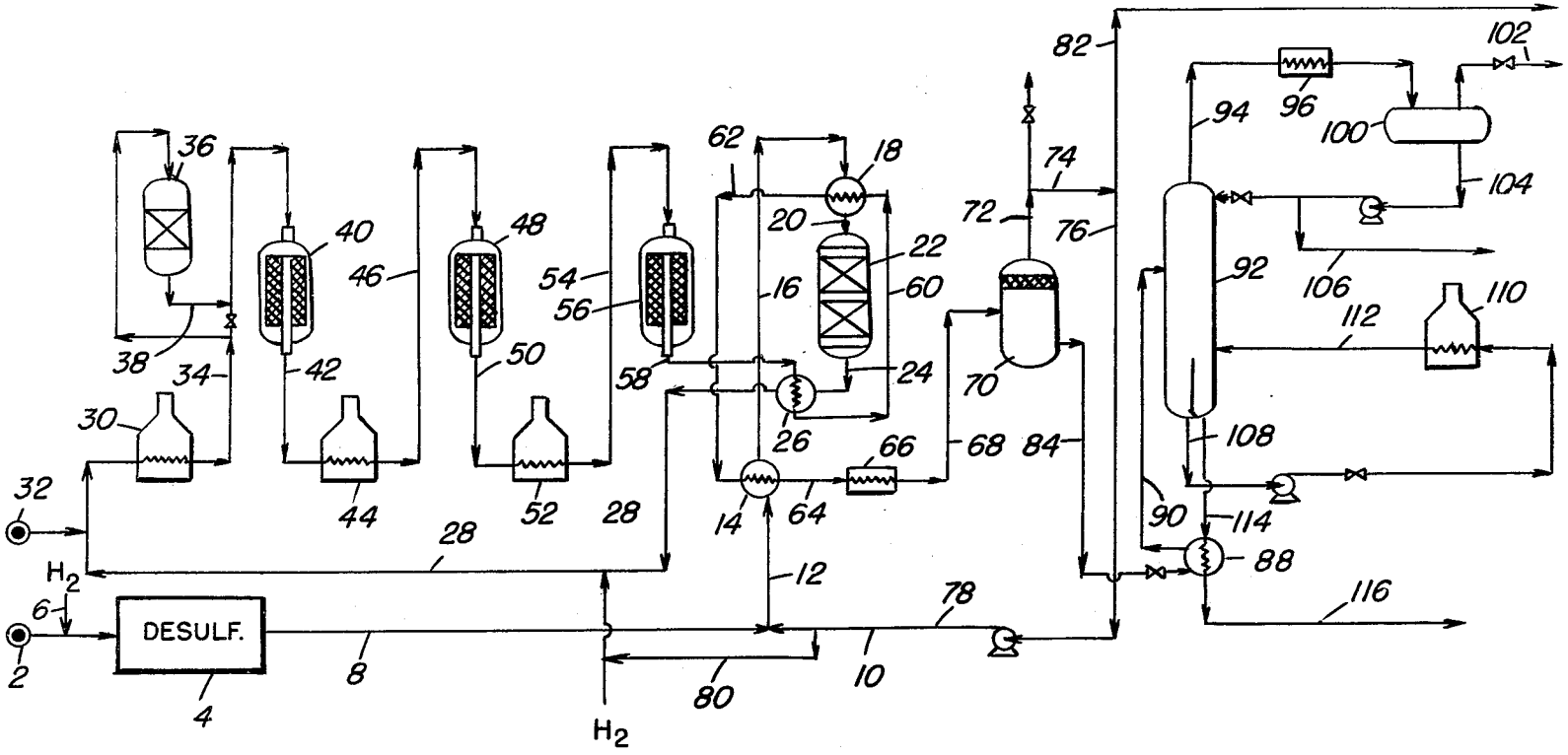
DESULF.
$H_2$
$H_2$

DESULFURIZATION OF NAPHTHA CHARGED TO BIMETALLIC CATALYST REFORMING

BACKGROUND OF THE INVENTION

Reforming with halogen promoted platinum-alumina catalyst alone or with metal promoters to form a bimetallic reforming catalyst now constitutes one of the major petroleum processing routes for upgrading naphtha boiling-range fractions to higher octane gasoline product. With a need to process relatively large volumes of naphthas, maintaining hydrogen purity of the reformer recycle gas in combination with gains in reformate product yield permits substantial savings in operating costs. A reformate yield improvement of only 0.5% by volume represents annual savings of several million dollars to the refining industry. However, to achieve these savings, it is important to charge clean naphthas of low sulfur and nitrogen content. The present invention is concerned with improving desulfurization of a naphtha fraction charged to a reforming operation whether employed in a regenerative, semi-regenerative or non-regenerative type reforming operation. In yet another aspect, the present invention is concerned with desulfurizing a wide boiling range sulfur containing naphtha fraction under conditions providing a desulfurized naphtha containing less than 0.5 ppm of sulfur and preferably not more than about 0.2 ppm of sulfur.

The combination of hydrogenative desulfurization of naptha containing material, separation of $C_5^-$ material including sulfur containing material and effecting catalytic reforming of the desulfurized naphtha with and without bimetallic reforming catalyst is known and disclosed in the prior art. Also effecting the reforming operation in the presence of selected amounts of water vapor, halogen addition and selectively presulfiding highly active fresh catalyst initially to restrict undesired hydrocracking activity of the catalyst is discussed at length in the prior art. Some U.S. patents particularly so directed include: U.S. Pat. Nos. 3,110,703; 3,193,495; 3,374,026; 3,415,737; 3,449,237; 3,562,147; 3,661,768; and 3,649,524.

SUMMARY OF THE INVENTION

The present invention is concerned with improving a bimetallic catalyst naphtha reforming operation by charging a desulfurized naphtha thereto comprising less than 0.5 ppm of sulfur and preferably containing not more than about 0.1 to 0.2 ppm by weight of sulfur.

Catalytic reforming is well known in the petroleum industry. The important hydrocarbon reactions encountered in reforming include dehydrogenation of naphthenes to form aromatics, dehydrocyclization of normal paraffins to naphthenes and aromatics, isomerization of normal paraffins and some hydrocracking depending upon the severity of the reforming operation. Thus, in any preliminary treatment of the naphtha charge, it is desirable to preserve those components of the charge readily converted to high octane products under carefully selected severity conditions in the substantial absence of producing undesired yields of light gaseous products and carbonaceous by-products.

It has been found, for example, that when a reforming operation is completed using very low sulfur levels in the naphtha charge; that is, below 0.5 ppm weight, that the hydrogen purity of recycle gas and liquid product yield recovered from bimetallic catalyst reforming may be maintained at high values for an extended operational period with either paraffinic or relatively wide boiling range naphtha charge stocks.

The reforming conditions will depend in large measure on the feed used, whether highly aromatic, paraffinic, naphthenic and various combinations thereof and upon the desired octane rating of the reformate product. The temperature of the reforming operation may be selected from within the range of 600° F. to about 1100° F. but more usually it is retained within the range of 700° F. to about 980° F. The pressure of the reforming operation may be as low as atmospheric pressure and as high as 1100 psig but preferably the pressure is maintained below 600 psig, more usually below about 400 psig, and as low as possible for achieving the results desired. The temperature, pressure and space velocity are correlated to favor particularly desired reactions of aromatization or cyclization, isomerization and dehydrogenation reactions. Some hydrocracking may also be required depending upon the composition of the charge to be processed. It is known that the hydrocracking activity of particularly fresh catalyst can be initially diminished by sulfiding the catalyst at least during its highest initial activity.

The bimetallic catalyst compositions employed in reforming operations include those comprising platinum, palladium or rhodium in combination with one or more metal promoters or metallic activating elements which form active catalyst complexes with a halogen promoter. Metallic activating elements that may be employed with the platinum group metal include cerium, ruthenium, rhenium, yttrium or other elements which complex with a halogen such as chlorine to form an active catalytic component. The concentration of the platinum group metal providing the hydrogenation-dehydrogenation function of the catalyst composite will generally be within the range of 0.01 up to 3 or 4 percent by weight but more usually is not above about 2 percent by weight. Preferably, this platinum metal component will be within the range of about 0.15 up to about 1 percent by weight.

A metallic activating agent or component is used in relatively small amounts and thus comprises a small part of the total catalyst complex. The metallic promoter component or element may be used in amounts which are equal to, more than, or less than the platinum group metal. The metallic promoter may be used in amounts preferably within the range of from about 0.05 percent up to about 2 or more percent by weight of the platinum group metal component. The metal components above identified are deposited on a suitable carrier material which is usually an inorganic metal oxide and preferably is an alumina in the gamma or eta form and/or mixtures thereof. The carrier material may also be combined with one or more elements of the Periodic Table selected from the group comprising magnesia, silica, titania and zirconia. A suitable carrier material is one selected from the group comprising silica-alumina, silica-magnesia, silica-alumina-zirconia and alumina silicates. The acid function of the catalyst may be implemented by the addition of halogen thereto. A halogen such as chlorine or fluorine may be incorporated with the catalyst by any number of suitable methods known in the prior art. For example, the halogen may be added during preparation by using chloroplatinic acid or it may be added in gas form as chlorine or fluorine. The halogen may be added after the catalyst preparation and/or with the naphtha charge stream as an organic or inorganic halide such as, for example, methylchloride, ammonium chloride, carbon tetrachloride, hydrochloric acid, chloroform or other suitable compositions comprising fluorine. The halogen content of the catalyst can be varied over wide limits in the range of about 0.01 up to as high as 10 percent by weight but more usually it is maintained less than about 5 percent by weight and/or equal to the weight percent of the platinum group metal or the metallic promoting element. That is, sufficient halogen is present to at least form a complex with the metallic promoting element, thereby greatly enhancing the activity and selectivity performance on the catalyst.

The desulfurization of naphtha charged to catalytic reforming has encountered many different processing arrangements depending on the boiling range of the naphtha to be processed, the sulfur content of the naphtha and the source of the naphtha to be reformed.

Providing a hydrocarbon charge material of very low sulfur content for charging to catalytic reforming has been an operational problem particularly associated with converting the sulfur containing naphtha charge to an acceptable desulfurized naphtha while retaining substantially its desired hydrocarbon components for catalytic reforming. Thus, as the severity of a desulfurization operation processing a wide boiling range charge is progressed to reduce residual sulfur therein below about 10 ppm, or more preferably below 5 ppm, the severe hydrogenation of the charge alters the composition of particularly a wide boiling range charge and thus contributes to an undesirable influence on the yield of desired high octane reformate product. It is known that the presence of sulfur in fairly high concentrations of 2 or more ppm and up to 5 or 10 ppm significantly decreases the activity and stability of a bimetallic reforming catalyst and thus its on-stream life.

In the case of low sulfur containing naphtha feedstocks, the severity of operation required to remove sulfur therefrom can often be obtained relatively easily in a presaturation zone wherein a naphtha boiling charge is contacted with hydrogen rich gas in the presence of a sulfur tolerant hydrogenation catalyst. Such sulfur resistant catalysts are known in the prior art and include one or more components of cobalt, molybedenum, nickel, tungsten and zirconium distributed in a suitable carrier material. Suitable catalyst for effecting desulfurization of naphtha include cobalt and molybdenum on an alumina support or nickel and tungsten on an alumina support. These catalysts may or may not contain silica and other promoter material known in the prior art.

Hydrodesulfurization of naphtha boiling range hydrocarbons is ordinarily accomplished at a temperature within the range of 550 to 950° F., more usually below about 800° F. using a pressure within the range of 200 to 2000 psig depending upon the severity required in the operation and a liquid hourly space velocity may be selected from within the range of 1 to 5. Under the conditions of the desulfurization operation selected, the sulfur present in the naphtha boiling-range charge is converted to hydrogen sulfide and thereafter separated from the desulfurized product by flashing, distillation or by any one of several methods known in the prior art.

The processing combination of this invention is particularly suitable for hydrodesulfurizing a wide boiling range hydrocarbon feed and/or any fractions thereof obtained from whole crude petroleum and comprising naphtha, kerosene and diesel oil fractions. The distillation operation relied upon to acquire a wide boiling range hydrocarbon fraction comprising naphtha is not a part of this invention. Various techniques for obtaining such a fraction are known in the prior art. One technique is disclosed in U.S. Pat. No. 3,193,495, issued July 6, 1965. Desulfurization of a wide boiling range charge material is preferably effected under temperature, pressure and space velocity severity conditions particularly effecting desulfurization and denitrogenation of the charge in the absence of significant and undesired hydrocracking of the charge. Thus, when a desulfurization operation is of a severity materially altering the charge composition as by hydrocracking, it is preferred to initially process naphtha containing material under less severe desulfurizing conditions which will permit recovering a naphtha boiling range fraction having an end boiling point below about 400° F. and comprising a residual sulfur content below about 5 ppm. More usually, the desulfurizing operation will be effected under conditions providing a naphtha boiling range fraction comprising 1 or 2 ppm of residual sulfur.

In accordance with this invention, a desulfurized naphtha fraction obtained under conditions to restrict hydrocracking of the charge and comprising 1 or 2 ppm of residual sulfur is further processed over a sequence of catalyst masses under selected conditions which will effectively reduce the sulfur content of the naphtha charge to at least 0.5 ppm but more usually to 0.1 or 0.2 ppm of sulfur. Desulfurizing a naphtha comprising from 0.5 ppm to about 5 ppm sulfur in accordance with this invention is accomplished by cascading the sulfur containing naphtha with added hydrogen over a combination of desulfurizing catalyst comprising, for example, a cobalt-molybdenum catalyst or other known desulfurizing catalyst under selected temperature, pressure and space velocity conditions sufficiently severe to produce hydrogen sulfide and thereafter passing the total effluent of the operation over a mass of catalyst comprising zinc oxide or other suitable metal oxide whereby sulfur comprising hydrogen sulfide formed in the operation is removed by the zinc oxide or metal oxide employed. In this specific combination of desulfurizing steps to reduce residual sulfur below 0.5 ppm, it is contemplated placing two separate beds of a bimetal desulfurizing catalyst each in sequential arrangement with a downstream bed of zinc oxide catalyst in parallel flow arrangement with respect to one another. The zinc oxide catalyst is in downstream sequential flow arrangement with respect to a desulfurizing catalyst such as a cobalt-molybdenum catalyst so that regeneration and/or replacement of the alone or in combination catalysts can be effected in a swing reactor arrangement. Providing the zinc oxide catalyst in one or more separate reactor adds versatility to the operation with the separate catalyst beds and particularly the on-stream life of the cobalt-molybdenum desulfurizing catalyst.

The charge stock to be reformed and desulfurized according to this invention comprises gasoline or naphtha boiling fractions of restricted or wide boiling range and comprising naphthenes, paraffins and aromatics. A preferred class of hydrocarbon fractions includes straight run gasolines, natural gasolines, synthetic gasolines, and the like. It is frequently desirable to process thermal and/or catalytically cracked gasolines of relatively low octane with and without higher boiling materials including materials boiling up to about 450° F. The naphtha boiling range charge stock may be a full boiling range charge material having an initial boiling point comprising $C_5$ hydrocarbons of about 50° F. boiling point and an end boiling point including kerosene boiling material of about 425° F. or 430° F. On the other hand, the naphtha processed may be restricted to materials boiling below about 400° F., below 380° F. or having an end boiling point not above about 360° F. Heavy naphtha boiling range charge materials comprising $C_{10}$ and $C_{11}$ hydrocarbons may be separately processed or included with the lower boiling naphtha charge.

In a more preferred aspect of this invention, a hydrocarbon fraction comprising naphtha boiling range material suitable for processing by catalytic reforming and recovered from a first or principal desulfurizing operation with greater than 0.5 ppm sulfur and preferably not above 1 to 2 ppm weight of sulfur is further contacted with hydrogen or a hydrogen rich gas obtained from an available source, and/or separated from the effluent of a reforming operation in a catalyst system comprising a known desulfurizing catalyst under selected severity conditions followed by contacting the total effluent therefrom with preferably a zinc oxide or other suitable metal oxide catalyst at a temperature within the range of 650 to 800° F. and an elevated pressure permitting cascade of the naphtha thus sequentially desulfurized to a catalyst reforming operation. The cleanup desulfurizing catalyst system above identified may comprise, for example, cobalt-molybdenum on alumina as the desulfurizing catalyst up-stream of the zinc oxide catalyst and a bed of each of these catalysts may be retained in separate reactors or in a common reactor vessel in sequential arrangement. During this sequence of catalyst contact steps, it has been found that the sulfur level of a naphtha boiling range charge can be reduced below 0.5 ppm and to a level as low as 0.1 or 0.2 ppm by weight of sulfur. Thereafter, the naphtha charge may be moisture and chloride adjusted if needed before passage in contact with a bimetallic reforming catalyst for rearrangement according to known bimetallic catalyst reforming technology.

In the investigation leading to the concepts of this invention, it has been found that increasing the sulfur content of a naphtha feed from less than 1 ppm to 4 ppm weight, increased the bimetallic reforming catalyst aging rate fourfold. Furthermore, operating with 4 ppm weight of sulfur in the feed resulted in a loss of from 3 to 4 percent by volume of $C_5$+ reformate yield.

In the combination of naphtha feed desulfurization followed by bimetallic catalytic reforming, the specific catalyst system of the invention comprising zinc oxide in combination with the desulfurizing catalyst is desirably located in the processing sequence wherein heating of the naphtha to be reformed can be indirectly accomplished with hot effluent material of reforming and restricted to within the range of about 650° to about 800° F. That is, the catalyst system comprising zinc oxide is positioned within a heat exchange arrangement comprising the effluent following the last reforming reactor stage which will provide the necessary desulfurizing reaction heat before passing the desulfurized naphtha comprising less than 0.5 ppm by weight sulfur to catalytic reforming.

DISCUSSION OF SPECIFIC EMBODIMENT

Referring now to the drawing by way of example, a wide boiling range fraction comprising $C_5$ and higher boiling naphtha hydrocarbons is charged to a primary desulfurizing step 4 by conduit 2. Hydrogen rich gas is introduced by conduit 6. In the primary desulfurization operation generically represented by box 4, the hydrocarbon charge comprising naphtha is desulfurized in the presence of a desulfurizing catalyst under conditions which restrict undesired hydrocracking of the charge and thus reduce the sulfur content of the charge to provide naphtha which contains less than about 5 ppm and preferably not more than about 1 or 2 ppm of sulfur. A desulfurized naphtha boiling below about 420° F. is separated and recovered from the desulfurizing operation by conduit 8. The desulfurized naphtha in conduit 8 comprising more than 0.5 ppm sulfur and as much as 2 ppm sulfur is combined with hydrogen rich gas in conduit 10, obtained as hereinafter discussed, for passage of the mixture by conduit 12 to indirect heat exchanger 14 wherein it is indirectly heated with the product effluent of the reforming operation. The naphtha comprising sulfur is partially heated in exchanger 14 and is then passed by conduit 16 to heat exchanger 18 wherein the sulfur containing naphtha is further heated by indirect heat exchange with the reformer product effluent to a temperature within the range of 600° to 800° F.

The preheated sulfur containing naphtha-hydrogen mixture which may comprise up to about 1 or 2 ppm of sulfur but preferably less than 2 ppm sulfur is then passed to reactor 22 by conduit 20. Reactor 22 comprises in a specific embodiment, an upper bed of cobalt-molybdenum desulfurizing catalyst and a lower bed of zinc oxide. As indicated above, other suitable catalyst combinations may be employed. In reactor 22 the naptha is desulfurized under selected temperature and pressure conditions by sequential contact with the catalyst beds thereby producing hydrogen sulfide removed by the zinc oxide to provide a desulfurized naphtha comprising not more than 0.5 ppm weight of sulfur and more usually less than 0.2 ppm sulfur. The desulfurized naphtha thus obtained is withdrawn from reactor 22 by conduit 24, passed through indirect heat exchanger 26 and thence by conduit 28 to heater 30. Chlorine and/or water may be added to the desulfurized naphtha in conduit 28 by conduit 32 as required to maintain the bimetallic reforming catalyst in a proper condition for the reforming operation.

In heater 30 the desulfurized naphtha is further heated to achieve a start of run temperature of about 870° F. and thereafter the temperature is raised as required until reaching an end of run temperature of about 980° or 1000° F.

The preheated naphtha is passed either directly to reforming reactor 40 or as required it may be passed by conduit 34 to a guard chamber 36 maintained at an elevated reforming pressure and temperature. Generally, the pressure of the combination operation will be below about 600 psig and as low as possible consistent with obtaining desired reforming results and permitting cascade of reactant through the processing arrangement. In a specific example, the pressure is about 440 psig. Guard chamber 36 may or may not be used as desired and is provided to house a bed of activated alumina to remove lead, arsenic and other undesired contaminants should they exist in the naphtha. On the other hand, a layer of alumina may be placed above the reforming catalyst in one or more of the reactors. The naphtha is passed sequentially through a series of reforming reaction and feed heating zones to maintain desired temperature reforming conditions during reforming of the naphtha to a higher octane product. That is, the naphtha desulfurized and otherwise heated as above discussed is passed by conduit 38 to the first reforming reactor 40 comprising a bimetallic reforming catalyst of the type discussed hereinbefore. A partially reformed product effluent of reduced temperature is recovered from reactor 40 by conduit 42, heated in furnace 44 to a desired elevated reforming temperature and then the effluent is passed by conduit 46 to reactor 48. As mentioned above, the reactions performed in the reforming operation comprises dehydrogenation, cyclization and isomerization. These reactions are most usually performed primarily in the first two reaction zones with some hydrocracking depending on the severity of conditions employed being effected in a third or more downstream reaction zones. That is, there may be four reforming zones. The reformed effluent recovered from the second reaction zone is passed by conduit 50 to furnace 52 for temperature adjustment and thence by conduit 54 to reaction zone 56.

A reformer effluent of desired high octane is recovered from the third reaction zone 56 or a last reaction zone at an elevated temperature within the range of 925° F. to about 980° F. depending on whether one is at the start of run or the end of run. The hot product effluent of reforming thus obtained requires cooling and may be used to preheat the charged sulfur containing naphtha passed to reaction zone 22 as well as the effluent obtained therefrom. That is, the hot effluent in conduit 58 is passed through indirect heat exchanger 26, then by conduit 60 to indirect heat exchanger 18, then by conduit 62 to heat exchanger 14, thereby reducing the reformer effluent to a desired low temperature suitable for separating the effluent in a downstream flash zone. A partially cooled effluent is recovered from heat exchanger 14 by conduit 64 and may be further cooled in cooler 66 to a temperature of about 110° F. The cooled reformer effluent is passed from cooler 66 by conduit 68 to drum 70 maintained at an elevated pressure of about 150 to 500 psig. In drum 70, an initial separation is made to recover a gaseous phase from higher boiling material. This gaseous phase is referred to herein as a fuel gas and is a hydrogen rich gas phase comprising low boiling materials including some hydrocarbons boiling up to and including normal hexane. This gaseous phase is recovered from 70 by conduit 72 with a substantial portion thereof being recycled as a hydrogen rich material by conduits 74, 76, 78 and 80 as shown in the drawing. Another portion is recovered by conduit 82 and may be recycled to the desulfurizing step 4 or passed to the off gas recovery system of the process which is not shown.

A liquid reformate fraction is recovered from drum 70 by conduit 84 at a low temperature of about 110° F. The effluent withdrawn by conduit 84 is passed to heat exchanger 88 wherein its temperature is indirectly raised to within a range of 280° to 295° F. The liquid portion of the reformer effluent thus recovered is then passed by conduit 90 to a debutanizer tower 92 maintained at a top temperature of about 173° F. and a bottom temperature within the range of about 425° F. to about 430° F. The tower pressure is about 270 psig.

In debutanizer tower 92, a separation is made to recover an overhead fraction boiling up to about 170° F. which is withdrawn from the top of the tower by conduit 94. This overhead fraction will be rich in $C_3$ to $C_5$ hydrocarbons and will contain some hydrogen as well as $C_1$ to $C_2$ hydrocarbons. The debutanizer overhead is cooled in cooler 96 and then it is passed by conduit 98 to drum 100 maintained at a temperature of about 110° F. and a pressure of about 260 psig. A fuel gas stream is recovered from drum 100 by conduit 102. A liquid reflux stream is recovered from drum 100 by conduit 104 and conveyed in part to the top portion of tower 92 as reflux. The remaining portion of this liquid material is recovered by conduit 106. The material in conduit 106 is rich in $C_2$ to $C_4$ hydrocarbons. A bottoms fraction is withdrawn by conduit 108 for passage to reboiler furnace 110 wherein the bottoms is heated to an elevated temperature of about 425° F. before return to the tower by conduit 112. Another portion of the bottoms obtained in tower 92 is withdrawn by conduit 114 at an elevated temperature of about 425° F. or higher and thence passed to indirect heat exchanger 88 used to effect preheating of the reformate product before passage to tower 92. The cooler reformate product in conduit 114 and withdrawn from heat exchanger 88 by conduit 116 is recovered as a reformate product of the combination process.

It will be recognized by those skilled in the art that the specific arrangement above defined for heat and cooling product material passed to and withdrawn from reactor 22 may be varied to some considerable degree from that discussed without departing from the essence of the invention.

Having thus generally described the invention and described a specific embodiment in support thereof, it is to be understood that no undue restrictions are to be imposed by reason thereof except as defined by the following claims.

I claim:

1. In a combination process for upgrading a naphtha fraction by desulfurization to reduce sulfur in the naphtha charge to within the range of 0.5 to 5 ppm and the naphtha is thereafter reformed by contact with a bimetallic reforming catalyst at a temperature in the range of 870° to 1100° F., the method for improving the combination process which comprises, passing the naphtha product of desulfurization and comprising from 0.5 to 5 ppm of sulfur in admixture with recycle hydrogen gas in indirect heat exchange with the effluent product of the reforming operation in a sequence of heat exchange zones whereby the product of desulfurization is heated to an elevated temperature of at least 600° F., passing the thus heated desulfurized naphtha comprising more than 0.5 ppm sulfur in sequential contact with additional desulfurizing catalyst maintained under conditions to form hydrogen sulfide and thereafter in contact with a metal oxide to remove said formed hydrogen sulfide and provide a desulfurized naphtha comprising less than 0.5 ppm of sulfur, passing the desulfurized naphtha comprising less than 0.5 ppm of sulfur in indirect heat exchange with the product effluent of reforming upon discharge from the final reforming zone thereby heating the desulfurized naphtha, and thereafter reforming the desulfurized naphtha thus obtained with a bimetallic reforming catalyst in a sequence of reforming zones.

2. The process of claim 1 wherein the desulfurized naphtha initially contains not more than about 2 ppm of sulfur and is reduced to less than 0.2 ppm by said further contact with a desulfurizing catalyst and a metal oxide before contacting said reforming catalyst.

3. The process of claim 1 wherein said metal oxide is zinc oxide arranged in one or more zones downstream of said desulfurizing catalyst.

* * * * *